US005217948A

United States Patent [19]

Leung et al.

[11] Patent Number: 5,217,948

[45] Date of Patent: Jun. 8, 1993

[54] PHASE CHANGE COOLING FOR AN ELECTROMAGNETIC LAUNCH

[75] Inventors: Eddie M. Leung; Scott D. Peck, both of San Diego, Calif.

[73] Assignee: General Dynamics Corporation, Space Systems Division, San Diego, Calif.

[21] Appl. No.: 779,544

[22] Filed: Oct. 18, 1991

[51] Int. Cl.[5] ..... F41B 6/00

[52] U.S. Cl. ..... 505/1; 89/8; 102/440; 102/704; 124/3

[58] Field of Search ..... 89/8; 102/367, 370, 102/440, 704; 124/3; 505/1

[56] References Cited

U.S. PATENT DOCUMENTS 4,997,047 3/1991 Schroeder ..... 175/4.5
5,017,549 5/1991 Robertson ..... 89/8

FOREIGN PATENT DOCUMENTS 238399 10/1988 Japan ..... 124/3

OTHER PUBLICATIONS

Kolm et al, Electromagnetic Launchers, American Chemical Society, 1979, pp. 2004–2012.
Kolm et al, Electromagnetic Launchers and Guns, AD-A143778, 1980, pp. 94–135.
Hull, John R., Application of Superconducting Technology To Earth-To-Orbit Electromagnetic Launch Systems, IEEE Transactions on Magnetics, vol. 25, No. 1, Jan 1989, pp. 243–248.

*Primary Examiner*—Stephen C. Bentley
*Attorney, Agent, or Firm*—John R. Duncan; Frank D. Gilliam

[57] ABSTRACT

The device employs Hybrid Pulsed Transformer principles employing a projectile with an internal pay load. The projectile carries a light weight shorted secondary coil or coils constructed of aluminum and the projectile acts as a moving secondary through a plurality of aligned spaced apart transformer primary coils. The moving secondary coil includes a plurality of surrounding channels containing a liquid, such as water, for cooling. The cooling ability of certain liquids, as for example water, associated with change of state between liquid and gas is employed to cool the coil or coils.

9 Claims, 1 Drawing Sheet

PHASE CHANGE COOLING FOR AN ELECTROMAGNETIC LAUNCH

BACKGROUND

1. Field of the Invention

This invention pertains generally to electromagnetic projectile launchers and particularly to the lightening of the weight of the secondary coil or coils associated with the projectile and the cooling thereof of heat absorbed from the primary coils during travel through a coaxial launcher.

2. Prior Art

U.S. patent application having the Ser. No. 07/489,318 assigned to the assignee of the present invention teaches a high efficiency coaxial launcher utilizing a projectile which includes a secondary coil or coils which react with superconducting primary coils to launch the projectile into Earth orbit. Maintaining the primary coils in superconductivity until a precise instant when they are driven normal to transfer electromagnetic force to the projectile. The teaching of this application does not discuss any means or method for cooling of the projectile which is heated progressively as it proceeds through a series of primary coils transferring energy thereto. Obviously, the heat of the projectile must remain below a temperature that would cause damage to the projectile.

Kolm et al., ELECTROMAGNET LAUNCHERS, American chemical Society, 1979, at pages 2004–2012; Kolm et al., ELECTROMAGNET LAUNCHERS AND GUNS, AD-A143778, 1980, at pages 94–135: and Hull, John R., APPLICATION OF SUPERCONDUCTING TECHNOLOGY TO EARTH-TO-ORBIT ELECTROMAGNETIC LAUNCH SYSTEMS, IEEE Transactions on Magnetics, Vol. 25, No. 1, January 1989, at pages 243–248 are directed to means and methods of launching projectiles into earth orbit and the like using superconducting primaries and normal secondary conductors carried by the projectile. The articles teach the necessity of maintaining the primary coils in a superconducting state until normalizing is required to timely propel the projectile.

A concern is noted in the articles that the heat of the projectile could become elevated to a superconducting quenching temperature as it absorbs energy from the primary coils and changing the superconducting primary coils from a superconducting state to a normal state. There is no teaching as to any means or method for cooling the projectile as it travels along the series of primary coils so as to prevent premature quenching of any of the superconducting primary coils.

There has been a long standing need in electromagnetic launchers to lighten the weight of the secondary coil or coils carried by the projectile being launched via transferred energy from superconductive primary coils and to dissipate heat from the projectile to prevent the projectile temperature from elevating to a level that could cause premature damage to secondary coils.

The state of the art evidenced by the above referenced prior art has been advanced by the introduction of the present invention directed to a new and more efficient operating coaxial launcher.

SUMMARY OF THE INVENTION

The principle purpose of this invention is to provide projectile cooling and reduction of weight of the secondary coil or coils carried by the projectile in an apparatus for accelerating payloads to large velocities and launching them into Earth orbit or deep space. The instant invention is employed with launchers that use superconducting primary coils and a normal secondary coil or coils carried by the projectile which use individual superconducting primary coils as switchable segments of the coaxial launcher. The primary coils are capable of being switched "off" very rapidly, by quenching them quickly, by using capacitor discharge over-current circuits. The high quench voltages normally experienced in such setups are avoided by application of the Hybrid Pulse Power Transformer (HPPT) U.S. Pat. No. 4,894,556, issued Jan. 16, 1990.

The present invention utilizes a liquid which is preferably water at an ambient temperature, super cooled or in the solid form of ice, the form selected for the required temperature rise to boiling for sufficient heat dissipation from the projectile to prevent premature projectile pay load destruction.

The principle object of this invention is to provide an improved launcher for placing a pay load in Earth or Space orbit.

Another object of this invention is to provide a coaxial launcher which does not require the switching of large voltages or currents.

Yet another object of this invention is to provide cooling for the translating secondary coil or coils of a space launcher so as to prevent premature damage to the secondary coil or coils of the secondary.

Still another object of this invention is to provide a fluid cooling system for the translating secondary coil or coils of a space launcher so as to prevent premature damage of the secondary coil or coils.

Still another object of this invention is to provide a coaxial launcher which utilizes individual superconducting coils as switchable elements of the launcher.

The subject mater which is regarded as this invention is particularly pointed out and distinctly claimed in the concluding portion of the specifications. The invention, however, as to its organization and operation, together with further objects and advantages thereof, will best be understood by reference to the accompanying drawings in which:

BRIEF DESCRIPTION OF THE DRAWING FIGURES

DETAILED DESCRIPTION OF THE PREFERRED EMBODIMENT OF THE INVENTION

An example of the principle of operation of a launch system the like of which this projectile and its cooling system may be employed can be found in U.S. Pat. No. 4,894,556, issued Jan. 16, 1990. The specific details of this type system does not form a part of the invention and therefore will not be discussed in any detail herein.

Figure 1:
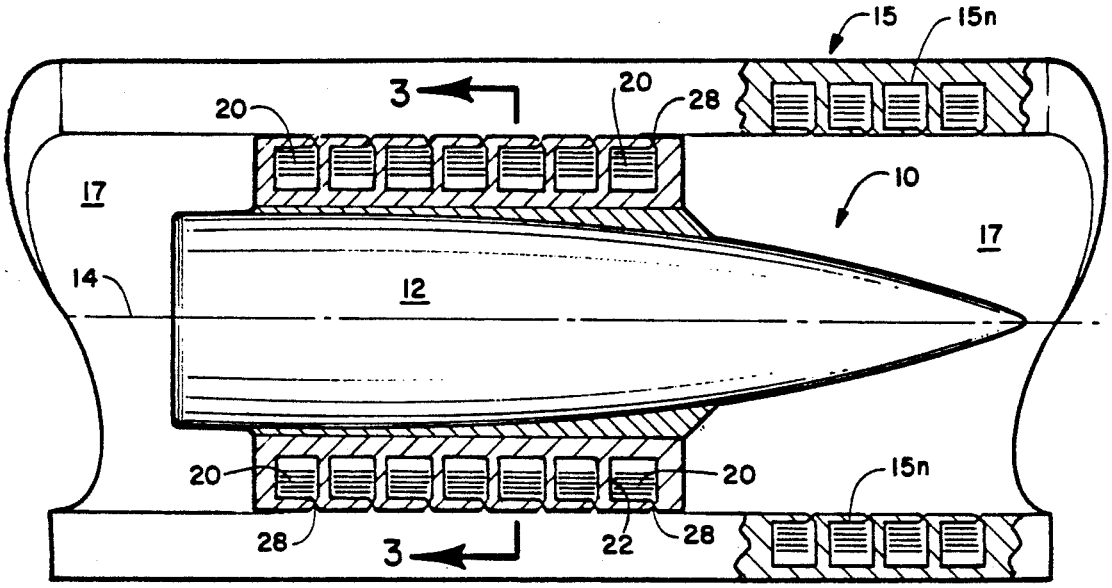
FIG. 1 is a cross-sectional schematic showing of the projectile and the cooling system of the invention taken along the longitudinal center line of the projectile.

Referring now specifically to drawing FIG. 1, a projectile 10 includes a pay load area 12. The line 14 denotes the longitudinal center line of the projectile 10.

Surrounding the projectile is a secondary winding 16. The primary windings 15, 15*n* fully described in the above noted U.S. Pat. No. 4,894,556, are positioned around the secondary winding 16 forming a barrel to interact therewith to launch the projectile and it pay load into space. During the travel of the projectile during launch it should be understood that a considerable amount of heat is absorbed by the projectile and secondary winding.

Figure 2:
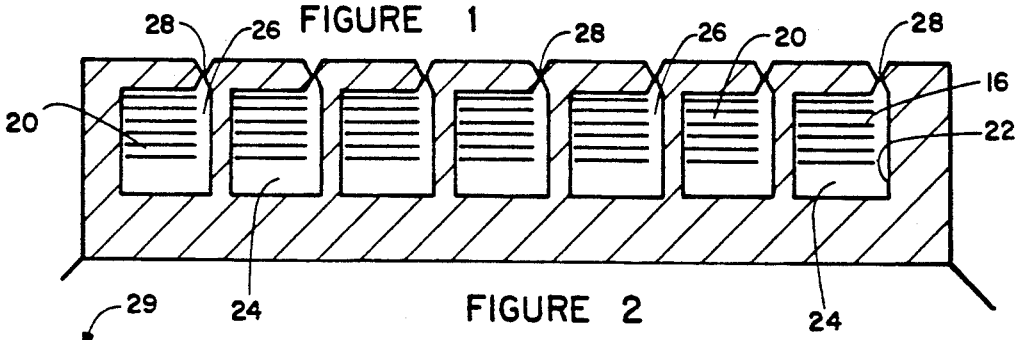
FIG. 2 is a schematic cutaway showing of cooling coils of the present invention.
Figure 3:
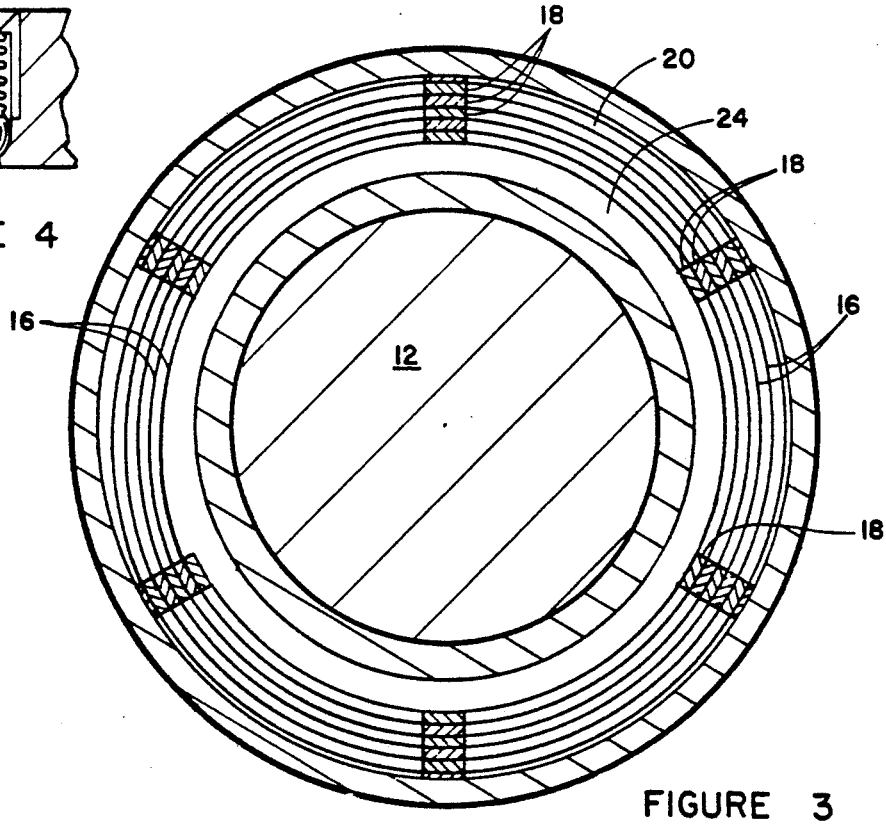
FIG. 3 is a schematic end view of the projectile of the invention taken along line 3—3 of FIG. 1.

Referring now also to drawing FIGS. 2 and 3, a plurality of spacers 18 are provided between the coil or coils windings 16. As can be seen in drawing FIG. 3 the coil or coils 16 are wound around the spacers in a common "jelly roll" fashion. It should be understood that any suitable winding configuration can be employed to practice this invention.

As can be seen in drawing FIG. 2, the windings are enclosed in a plurality of closed adjacent cell like structures 20. The number of cell like structures is determined by the size and weight of the projectile and related primary coil structure.

The windings are shown as not entirely filling the entire inner cavity 22 of the cell like structure thereby forming a reservoir area 24 for containing additional fluid. The portion 24 and side areas 26 remain free of coil or coils structure 16 and therefore the heat generated thereby. The cells are filled with a fluid, as for example water, preferably, but not by way of limitation, as water has the highest heat vaporization among common liquids and therefore, also has the highest peak nucleate boiling heat flux as well. Any specialty fluids that are now available or later developed which have a better rating than water or even somewhat less than water may be used if suitable for the purpose intended.

Figure 4:
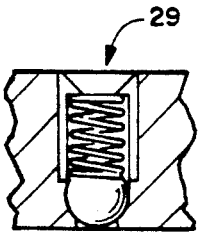
FIG. 4 depicts a pressure relief valve.

At the outer edge of side area 26 adjacent to the outer end the cells 20 is a vent 28 open to the launch vehicle that allows boil off gas from the change of state of the liquid due to an increase in temperature to escape. This vent can be of a selected size to allow a predetermined amount of gas to escape, can have a poppet valve 29 for release of gas only after that gas has reached a predetermined pressure, other means may also be employed for selectively venting the gas from the cells. The poppet valve 29, as shown in FIG. 4, is of the spring biased ball type commonly known in the art. It should be understood that other type poppet or pressure relief valve could be used to practice this invention. It should be understood that although fluid in the form of a liquid has been described as the desired medium for the cooling, if a slower heat rate is desired the liquid can be supercooled or in a solid form, such as, ice or the like.

By employing this invention using an open vent 28, the weight of, for example, a coil constructed from aluminum can be reduced to about one fifth of expected weight of a coil constructed of aluminum not employing the invention. This weight is even further reduced by the venting of the gas from the cells in a controlled manner.

While described above are the principles of an embodiment of the phase change cooling for an electromagnetic launch of the invention in connection with specific apparatus it is to be clearly understood that this description is made only by way of example and not as a limitation to the scope of the invention as set forth in the summary thereof and in the accompanying claims.

What is claimed is:

1. Phase change cooling for a projectile used in a electromagnetic launch thereof comprising:

a plurality of primary electromagnetic coils for generating an electromagnetic force field forming a barrel through which said projectile is launched;

at least one shorted secondary coil having a plurality of windings surrounding said projectile for interaction with said plurality of electromagnetic coils for initiating the launch of said projectile along and launched from said barrel formed thereby, said electromagnetic force field causing the temperature of said at least one shorted secondary coil to be elevated thereby during launch; and a fluid that changes to a gaseous state when exposed to the elevated heat of said secondary coil during launch;

said at least one shorted secondary coil being housed within a closed cell structure having a vent opening, said cell structure containing said fluid, said plurality of windings being spaced apart with said spaces being emersed in said fluid whereby when said fluid changes to a gaseous state the gas can escape from said vent opening thereby cooling said secondary coil during launch.

2. The invention as defined in claim 1 wherein said fluid is in a solid state prior to said initiating the launch.

3. The invention as defined in claim 1 wherein said fluid is water.

4. The invention as defined in claim 2 wherein said fluid is in the form of ice prior to said initiating the launch.

5. The invention as defined in claim 1 wherein said vent opening is covered by a poppet valve for selective release of said gas.

6. The invention as defined in claim 1 wherein said cell additionally comprises a fluid reservoir adjacent to said windings.

7. The invention as defined in claim 1 wherein said at least one secondary coil comprises a plurality of juxtaposed secondary coils each of which are housed in a winding closed cell with a vent opening.

8. The invention as defined in claim 7 wherein said vent opening in each of said cells is covered by a poppet valve for selective release of said gas.

9. The invention as defined in claim 7 wherein each of said cells additionally comprises a fluid reservoir adjacent to said windings.

* * * * *